US012528024B2

(12) United States Patent
Wang

(10) Patent No.: US 12,528,024 B2
(45) Date of Patent: Jan. 20, 2026

(54) TOY TRACK SET

(71) Applicant: ZHEJIANG FEIYUAN TECHNOLOGY CO., LTD, Hangzhou (CN)

(72) Inventor: Xueliang Wang, Jiaxing (CN)

(73) Assignee: ZHEJIANG FEIYUAN TECHNOLOGY CO., LTD, Hangzhou (CN)

( * ) Notice: Subject to any disclaimer, the term of this patent is extended or adjusted under 35 U.S.C. 154(b) by 599 days.

(21) Appl. No.: 18/055,402

(22) Filed: Nov. 14, 2022

(65) Prior Publication Data

US 2024/0042339 A1 Feb. 8, 2024

(30) Foreign Application Priority Data

Aug. 5, 2022 (CN) ..... 202222046925.2

(51) Int. Cl.
*A63H 18/02* (2006.01)
*A63F 7/36* (2006.01)

(52) U.S. Cl.
CPC ..... *A63H 18/02* (2013.01); *A63F 7/3622* (2013.01)

(58) Field of Classification Search
CPC ..... A63H 18/02; A63H 18/028; A63H 33/26; A63H 18/04; A63F 7/3622; A63F 2007/3662; F16B 21/071; F16B 2200/83
USPC ..... D21/564, 345, 565, 404; 446/168; 238/10 A, 10 E, 10 R; 463/69
See application file for complete search history.

(56) References Cited

U.S. PATENT DOCUMENTS

| | | | | | |
|---|---|---|---|---|---|
| 925,332 | A | * | 6/1909 | Grant | E01B 11/32 238/10 R |
| D918,313 | S | * | 5/2021 | Wang | D21/565 |
| D977,034 | S | * | 1/2023 | Wu | D21/484 |
| D1,048,216 | S | * | 10/2024 | Wang | D21/404 |
| D1,048,217 | S | * | 10/2024 | Wang | D21/504 |
| D1,064,107 | S | * | 2/2025 | Wang | D21/496 |
| 2020/0360827 | A1 | * | 11/2020 | Wang | A63H 33/26 |

* cited by examiner

*Primary Examiner* — Zachary L Kuhfuss
(74) *Attorney, Agent, or Firm* — HOWARD M COHN and Associates, LLC

(57) ABSTRACT

A toy track set includes a plurality of track sections, magnetic blocks, and a toy ball. The plurality of the track sections includes a first track section, a second track section, a third track section, a fourth track section, a fifth track section, a sixth track section, a seventh track section, an eighth track section, a ninth track section, and a tenth track section. Connecting columns of the track sections are capable of matching with connecting holes on both sides of magnetic blocks. The track sections may be matched in pair, meanwhile, an assembling direction may be changed.

9 Claims, 17 Drawing Sheets

TOY TRACK SET

TECHNICAL FIELD

The present disclosure relates to a technical field of building toys, and in particular to a toy track set.

BACKGROUND

Toy track sets are generally made of wood or plastic, and track sections of which can be freely assembled and simply disassembled. When children play with the toy track sets, through touching by hands and observing by eyes, ability to coordinate and balance bodies of the children is improved. However, the track sections, having different sizes, of the toy track sets in the market are designed to be in interference fit, which is easy to wear. Moreover, tautness of the toy track sets cannot be well controlled, which is not so entertaining and interest.

SUMMARY

The present disclosure aims to provide a toy track set, which is simple in structure, fast in assemble speed, various in ways to play, and further effectively improves entertainment and enjoyment of the toy track set.

In order to achieve above aims, the present disclosure provides a toy track set, including a plurality of track sections, magnetic blocks, and a toy ball, and the plurality of the track sections is in different shapes.

Furthermore, the plurality of the track sections includes a first track section, a second track section, a third track section, a fourth track section, a fifth track section, a sixth track section, a seventh track section, an eighth track section, a ninth track section, and a tenth track section. The first track section and the second track section are straight-shaped, the third track section is in a slope-shaped, the fourth track section is S-shaped, the fifth track section and the sixth track section are cross-shaped, the seventh track section is 90-degree bent, the eighth track section is 180-degree bent, and the ninth track section and the tenth track section are disk-shaped.

Furthermore, connecting platforms are respectively disposed on each of connecting ends of each of the first track section, the second track section, the third track section, the fourth track section, the fifth track section, the sixth track section, the seventh track section, the eighth track section, the ninth track section, and the tenth track section. An inserting column is disposed on a middle of each of the connecting platforms. A respective one of inverted buckles is disposed on an outer side surface of the inserting column. One of connecting columns and one of connecting holes are respectively disposed on two sides of each of the connecting platforms. Any two of the plurality of the track sections are mutually connected through the connecting columns and the connecting holes, and outer diameters of path opening extensions of the connecting platforms are the same.

Furthermore, a polygonal hole is defined on each of the magnetic blocks, and four round holes and four long oval holes are evenly defined around the polygonal hole. An internal diameter of the polygonal hole is larger than the outer diameters of the path opening extensions of the connecting platforms, and the polygonal hole is capable of accommodating each of the path opening extensions of the connecting platforms.

Furthermore, magnets are disposed on four side surfaces of each of the magnetic blocks, and the magnetic blocks are connected together through magnetic force.

Furthermore, a respective one of concave platforms are disposed on an inner side of a respective one of the four round holes of each of the magnetic blocks, the inserting column of each of the connecting platforms is capable of inserting into the respective one of the four round holes of each of the magnetic blocks. A respective one of the inverted buckles, on the inserting column, is buckled on the respective one of the concave platforms, disposed on the inner side of the respective one of the round holes of each of the magnetic blocks for tightly assembling the toy track set.

Furthermore, two surfaces of each of the magnetic blocks are capable of simultaneously connecting with the plurality of the track sections. After one of the plurality of the track sections is connected to a first side of a respective one of the magnetic blocks, a respective one of the connecting columns and a respective one of the connecting holes on two sides of a respective one of the connecting platforms of the one of the plurality of the track sections penetrate through a respective one of long oval holes on the respective one of the magnetic blocks to connect to another one of the plurality of the track sections at a second side of the respective one of the magnetic locks.

Furthermore, an inserting column on each of the plurality of the track sections is capable of inserting into any one of four round holes on each of the magnetic blocks for changing an assembling direction of the plurality of the track sections to achieve changes in four directions.

Furthermore, identical two of the plurality of the track sections are buckled and assembled from up and down to together connect to a respective one of the magnetic blocks.

Furthermore, the plurality of the track sections and the magnetic blocks are assembled to form different paths, and the toy ball is capable of rolling in the different paths.

Compared with the prior art, the present disclosure has following advantages:

The present disclosure provides the toy track set having a plurality of connecting points, a plurality of barb structures, a plurality of assembling positions, and a plurality of track section shapes, which is fast in assemble speed, easy to disassemble, various in ways to play, and further effectively improves entertainment and enjoyment of the toy track set.

Reference number in drawings: 1. first track section; 2. second track section; 3. third track section; 4. fourth track section; 5. fifth track section 6. sixth track section; 7. seventh track section; 8. eighth track section 9. ninth track section; 10. tenth track section; 100. connecting platform; 101. inserting column; 102. connecting column; 103. connecting hole; 104. path opening extension; 105. inverted buckle; 201. polygonal hole; 202. round hole; 203. long oval hole; 204. concave platform; 11. magnetic block; 111. magnetic block cover; 112. magnetic block bottom; 113. magnet; R1. outer diameter of the path opening extension; R2. internal diameter of the polygonal hole; and 12. toy ball.

DETAILED DESCRIPTION

Figure 1:
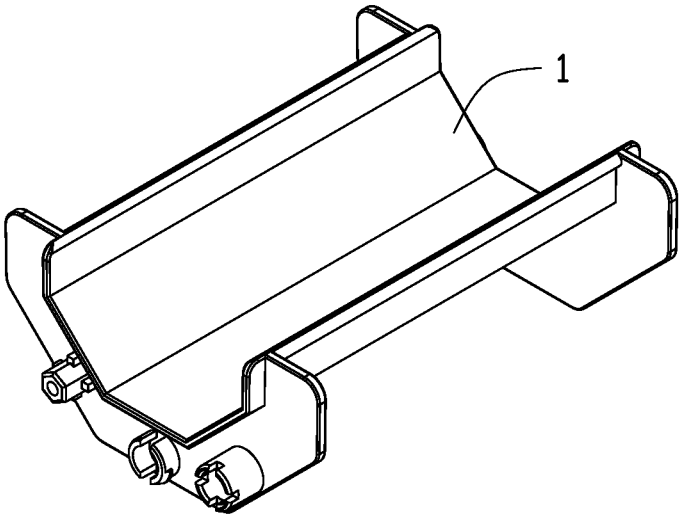
FIG. 1 is a structural schematic diagram of a first track section of the present disclosure.
Figure 2:
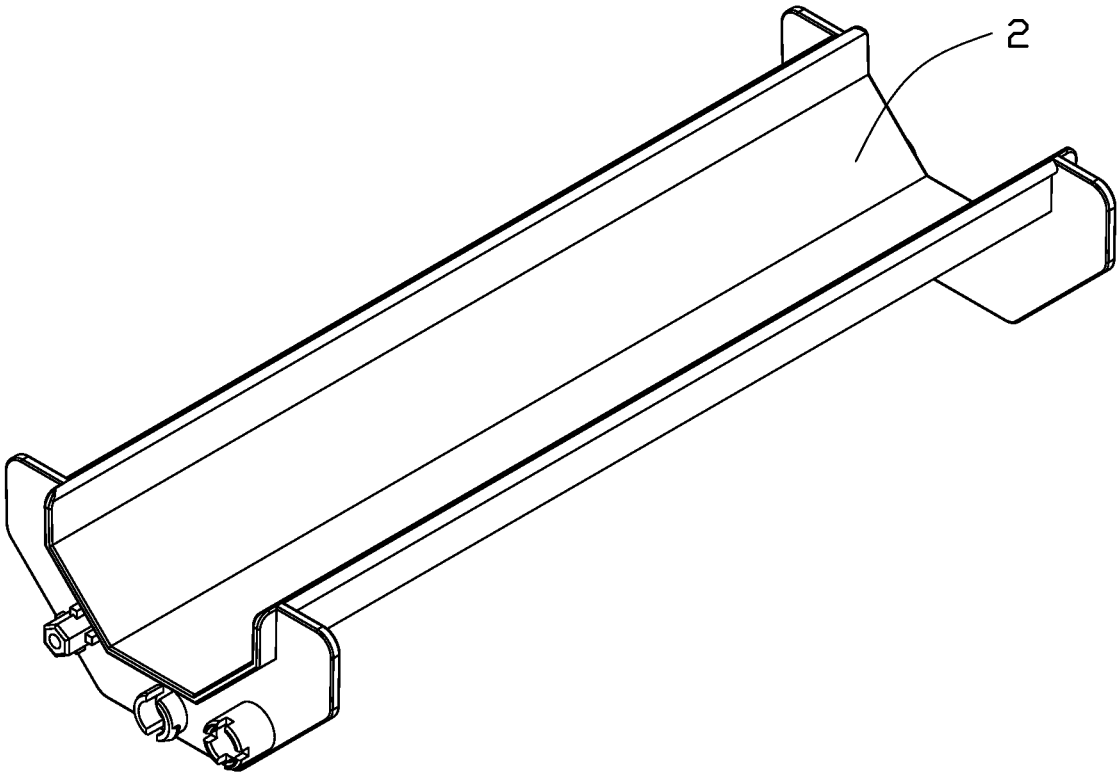
FIG. 2 is a structural schematic diagram of a second track section of the present disclosure.

Referring to FIGS. 1-2, a first track section and a second track section of the present disclosure which are straight-shaped are respectively shown. The first track section and the second track section are configured to straightly roll a toy ball 12, a length of the second track section is two times that of the first track section.

Figure 3:
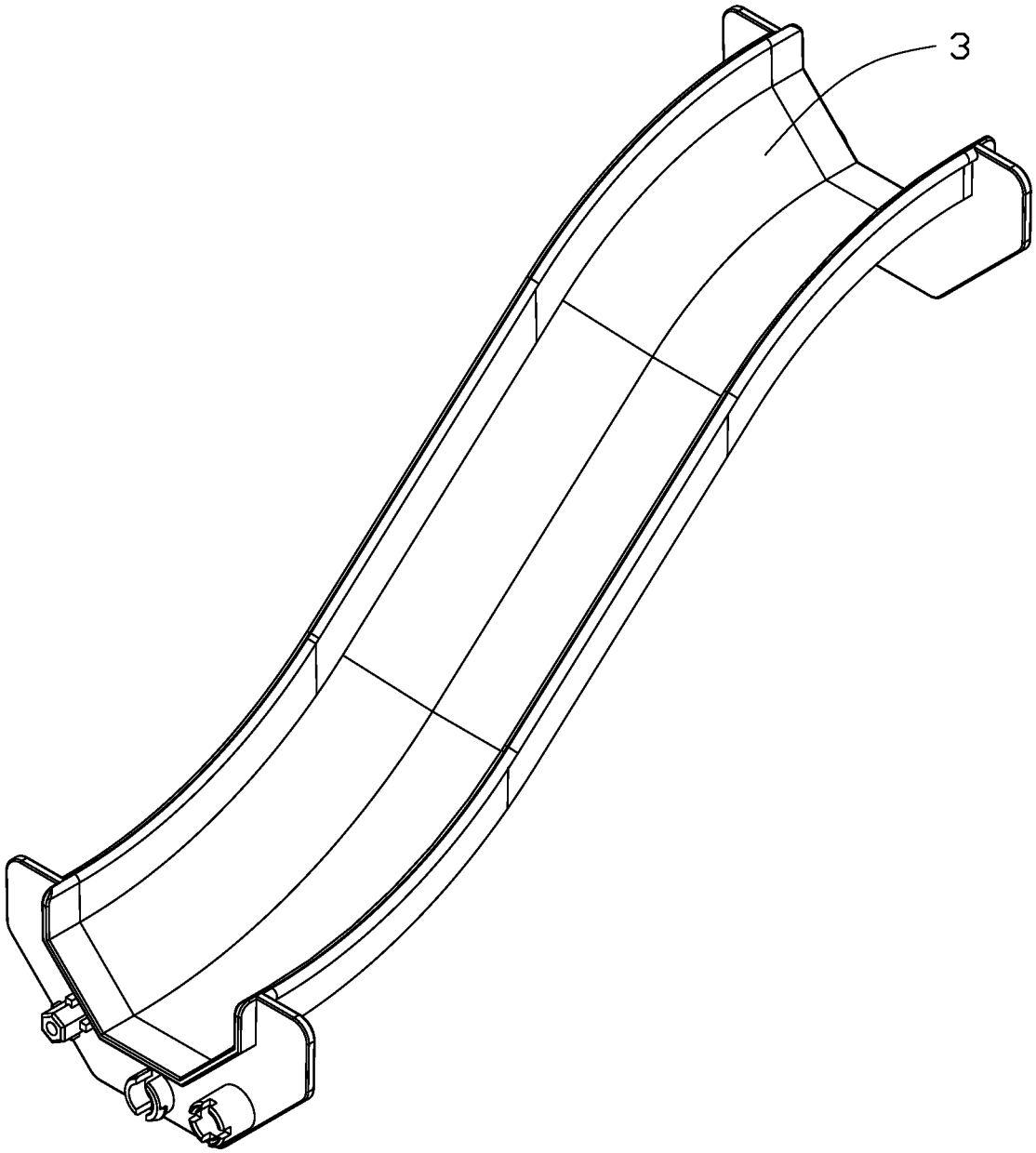
FIG. 3 is a structural schematic diagram of a third track section of the present disclosure.

Referring to FIG. 3, a third track section of the present disclosure which is slop-shaped is shown. The third track section is configured to slide down and roll the toy ball 12. A horizontal length of the third track section is the same as the length of the second track section.

Figure 4:
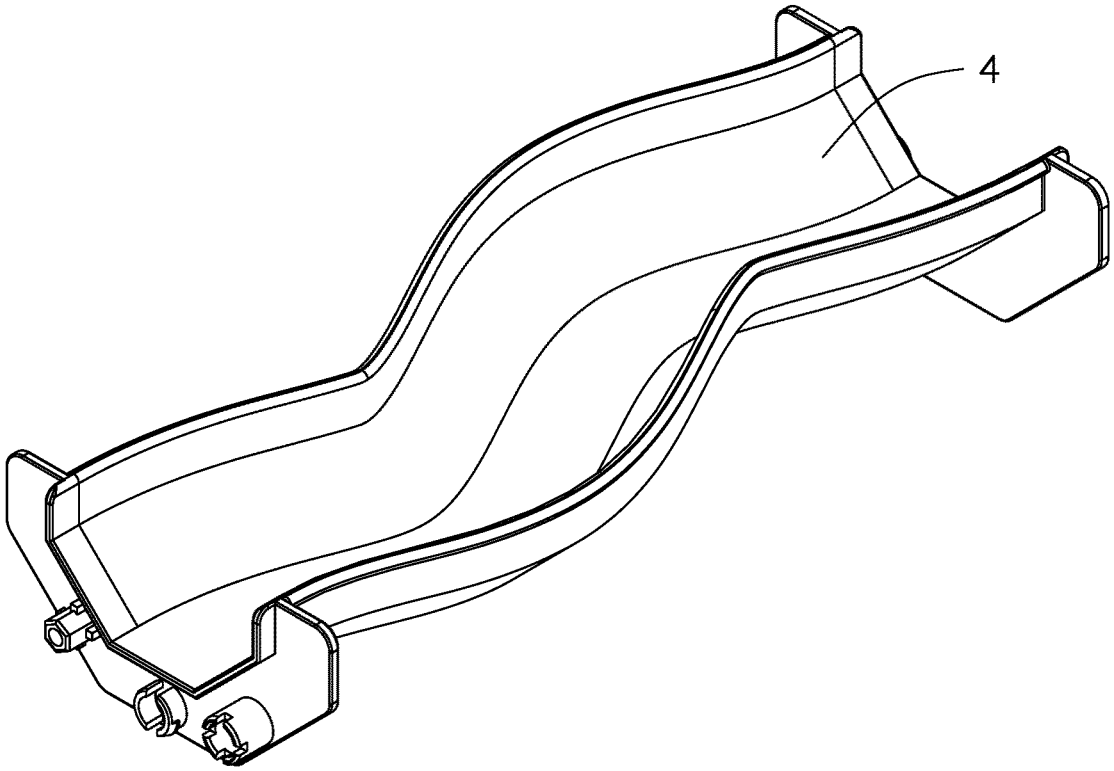
FIG. 4 is a structural schematic diagram of a fourth track section of the present disclosure.

Referring to FIG. 4, a fourth track section of the present disclosure which is S-shaped is shown. The fourth track section is configured to roll the toy ball 12 in a curved line. A horizontal length of the fourth track section is the same as the length of the second track section.

Figure 5:
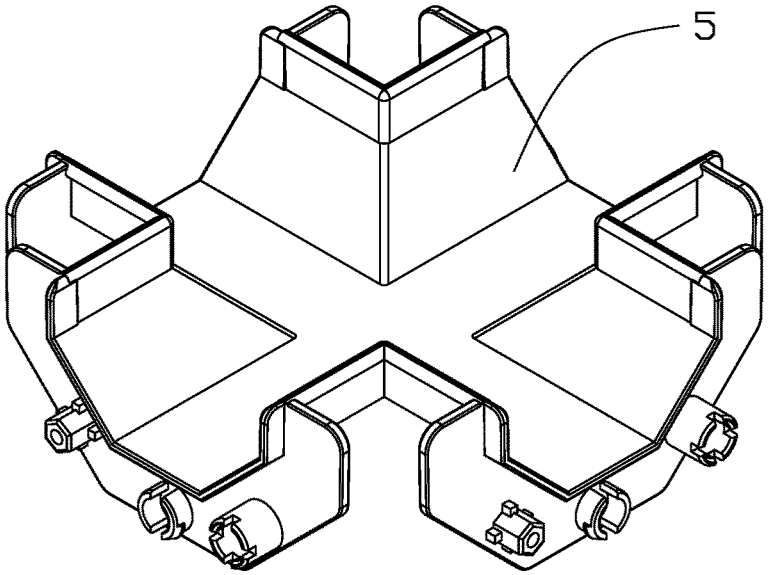
FIG. 5 is a structural schematic diagram of a fifth track section of the present disclosure.
Figure 6:
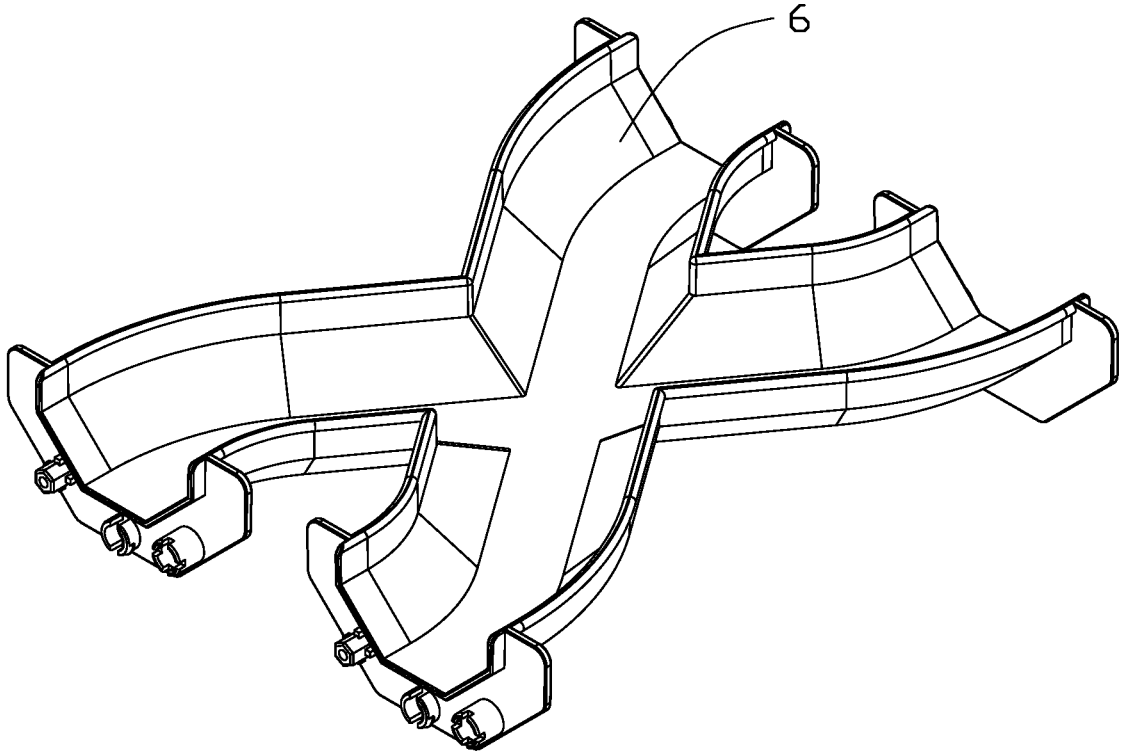
FIG. 6 is a structural schematic diagram of a sixth track section of the present disclosure.

Referring to FIGS. 5-6, a fifth track section and a sixth track section are respectively shown. The fifth track section is +-shaped, and the sixth track section is X-shaped. The fifth track section and the sixth track section are all configured to form intersection for the toy ball 12 to roll in two different paths. Lengths of the fifth track section in two directions are the same as the length of the first track section, and a horizontal length of the sixth track section is the same as the length of the second track section.

Figure 7:
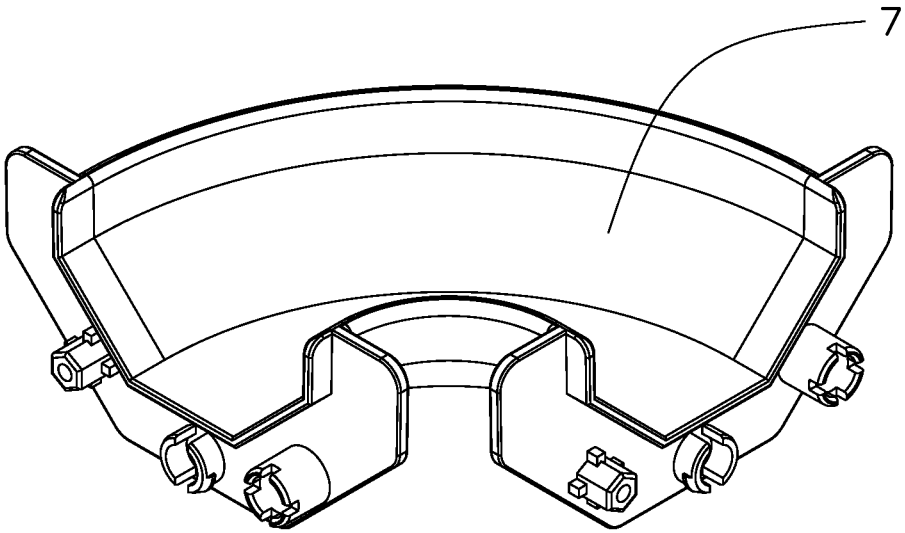
FIG. 7 is a structural schematic diagram of a seventh track section of the present disclosure.

Referring to FIG. 7, the seventh track section of the present disclosure is shown, the seventh track section is 90-degree bent and is configured to roll the toy ball 12 in 90-degree turns.

Figure 8:
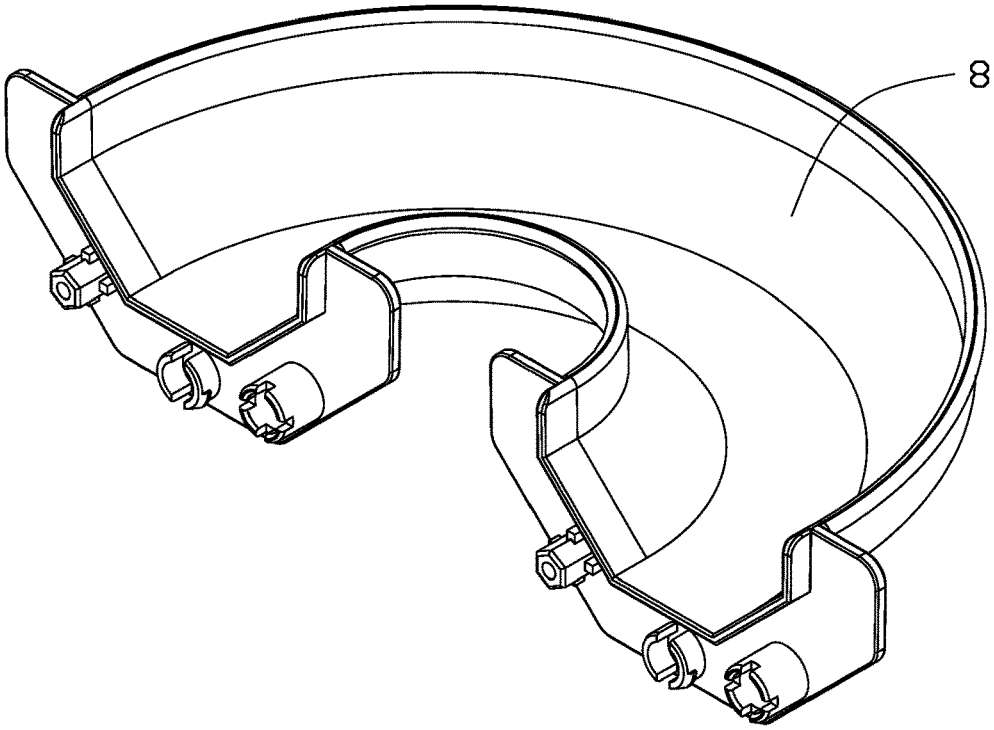
FIG. 8 is a structural schematic diagram of an eighth track section of the present disclosure.

Referring to FIG. 8, the eighth track section of the present disclosure is shown, the eighth track section is 180-degree bent and is configured to roll the toy ball 12 in 180-degree turns.

Figure 9:
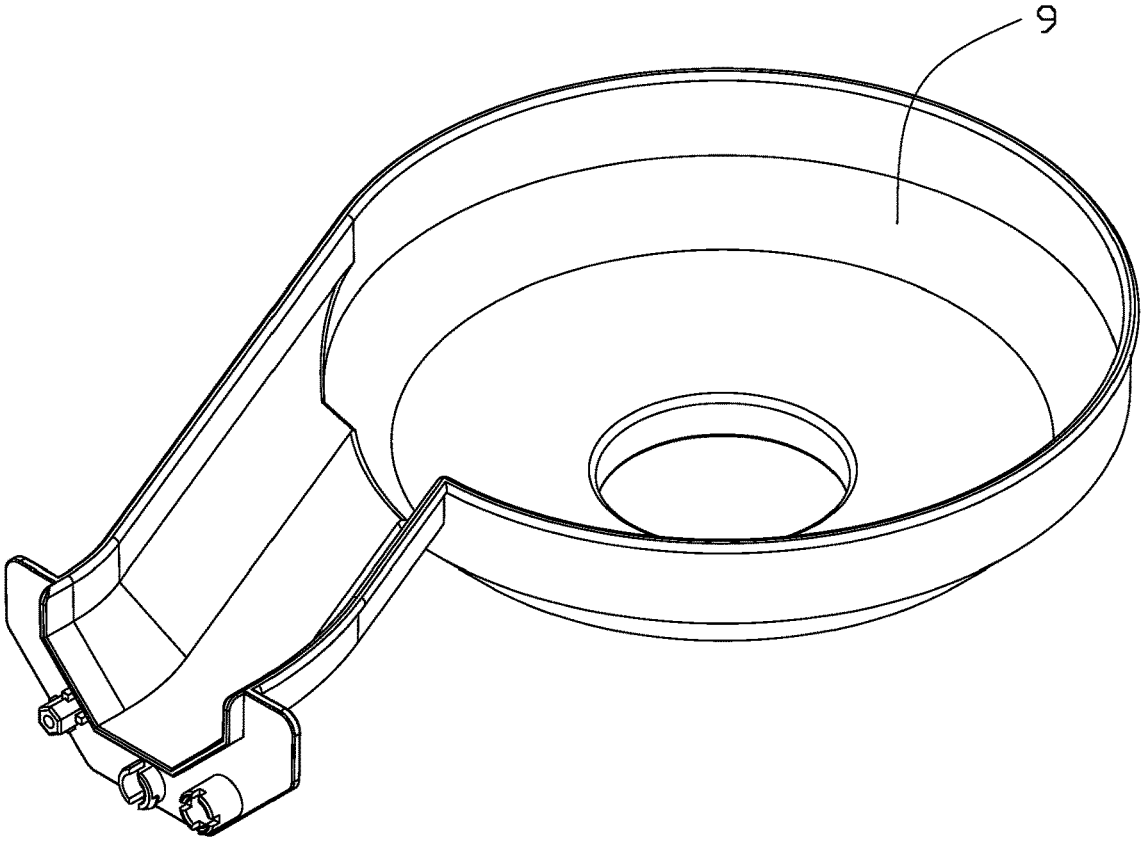
FIG. 9 is a structural schematic diagram of a ninth track section of the present disclosure.
Figure 10:
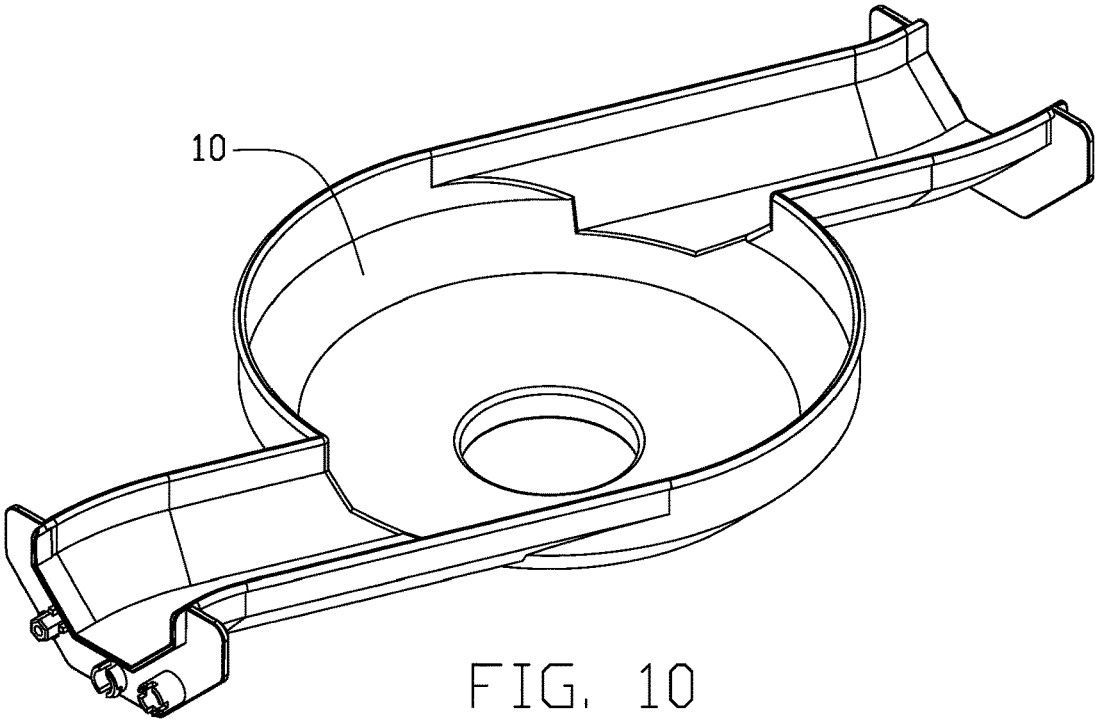
FIG. 10 is a structural schematic diagram of a tenth track section of the present disclosure.

Referring to FIGS. 9-10, the ninth track section and the tenth track section of the present disclosure are respectively shown. The ninth track section is disc-shaped and has a single outlet, the tenth track section is disc-shaped and has double outlets. The ninth track section and the tenth track section are all configured to rotate and roll the toy ball 12 after entering disc-shaped track sections.

Figure 11:
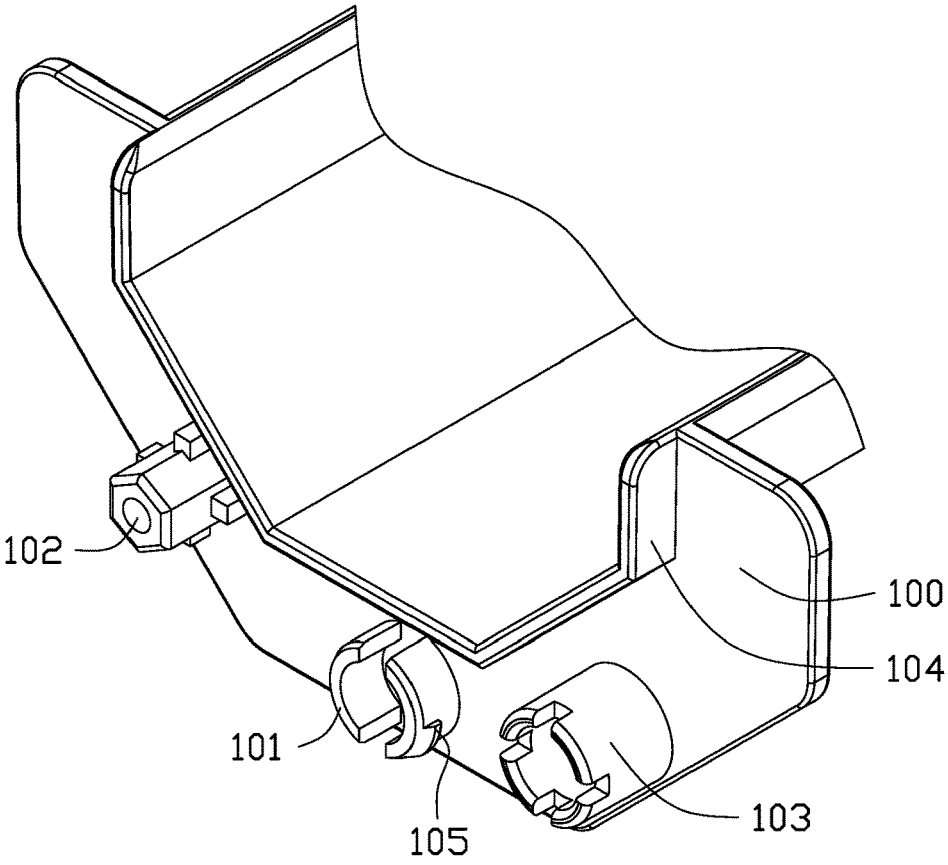
FIG. 11 is a three-dimensional structural schematic diagram of a connecting platform of each of the track sections of the present disclosure.
Figure 12:
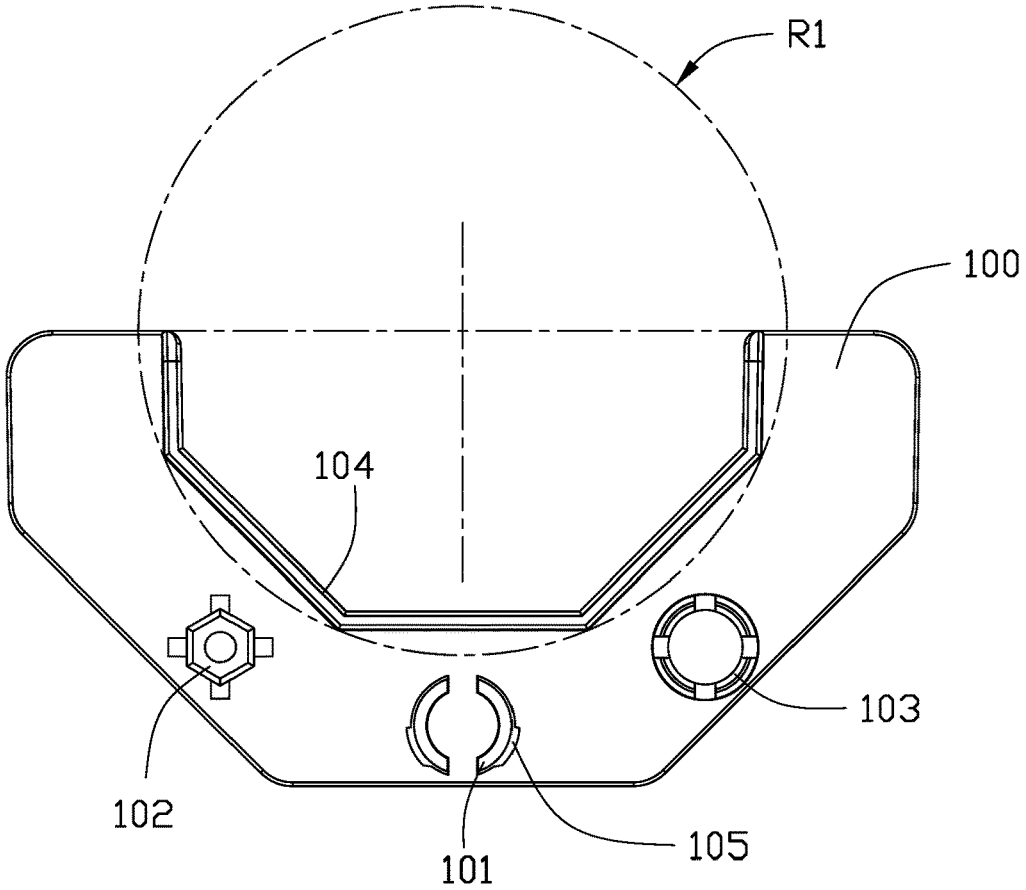
FIG. 12 is a front schematic diagram of a connecting platform of each of the track sections of the present disclosure.
Figure 13:
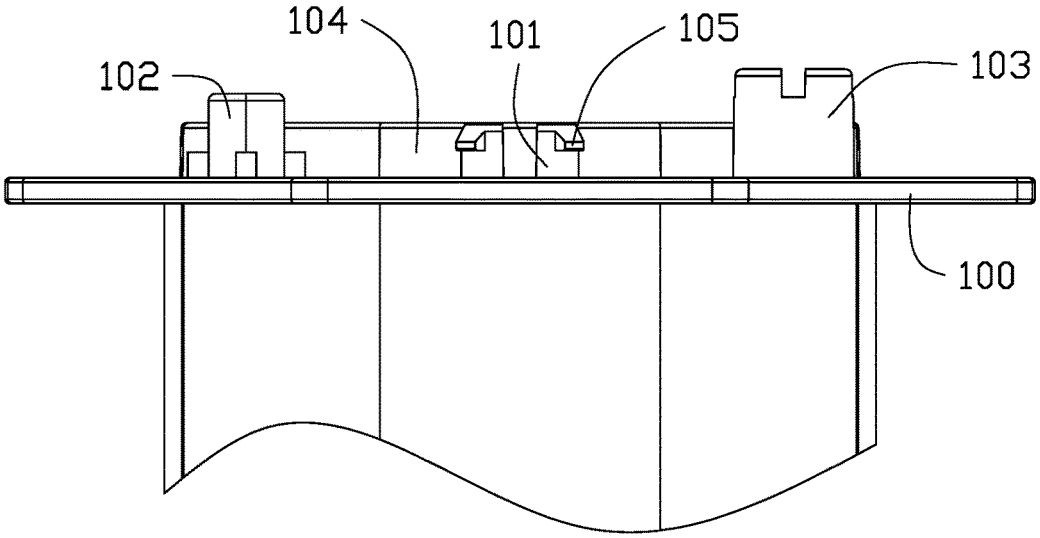
FIG. 13 is a bottom schematic diagram of a connecting platform of each of the track sections of the present disclosure.

As shown in FIGS. 11-13, one of connecting ends on each of the track sections is shown. Connecting platforms 100 are respectively disposed on each of the connecting ends of each of the first track section, the second track section, the third track section, the fourth track section, the fifth track section, the sixth track section, the seventh track section, the eighth track section, the ninth track section, and the tenth track section. An inserting column 101 is disposed on a middle of each of the connecting platforms 100 A respective one of inverted buckles 105 is disposed on an outer side surface of the inserting column 101. One of connecting columns 102 and one of connecting holes 103 are respectively disposed on two sides of each of the connecting platforms 100. Locations and sizes of the inserting column 101, the connecting columns 102, and the connecting holes 103 are all the same. Outer diameters R1 of path opening extensions 104 of the connecting platforms 100 are the same.

Figure 14:
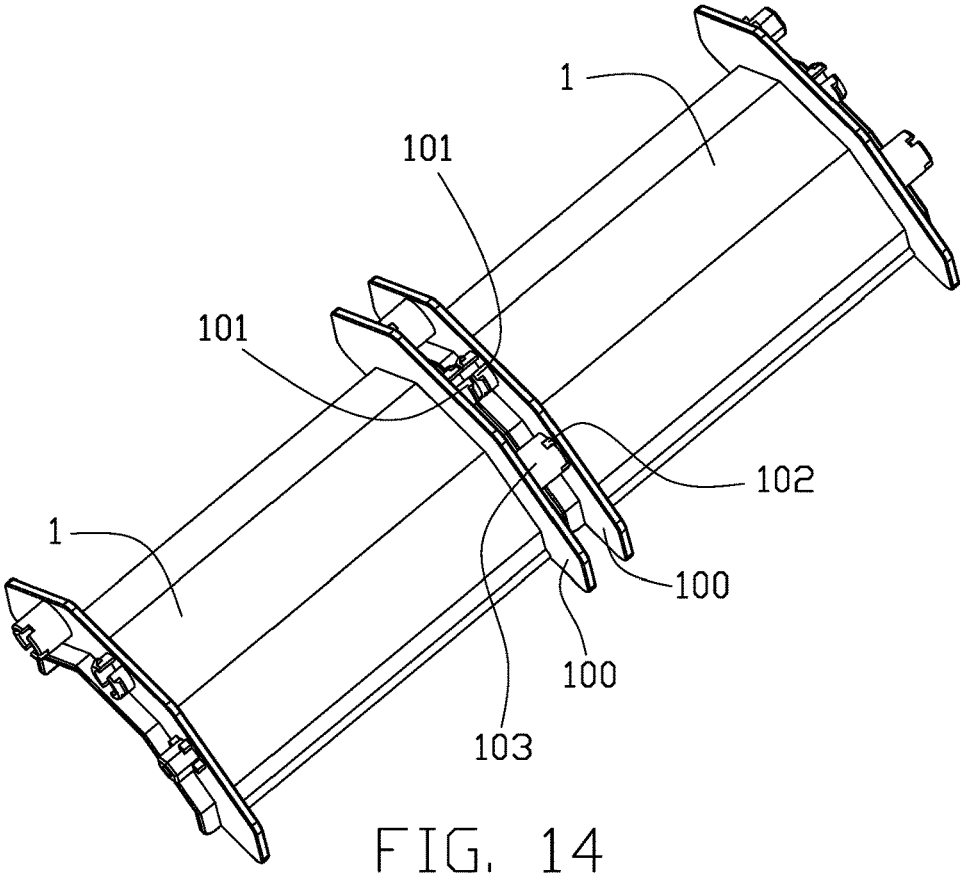
FIG. 14 is a schematic diagram of a connection between the track sections of the present disclosure.

Referring to FIG. 14 and taking the first track section as a connection embodiment, any two of the track sections, not limited to two track sections having same shape, are mutually connected through the connecting columns 102 and the connecting holes 103.

Figure 15:
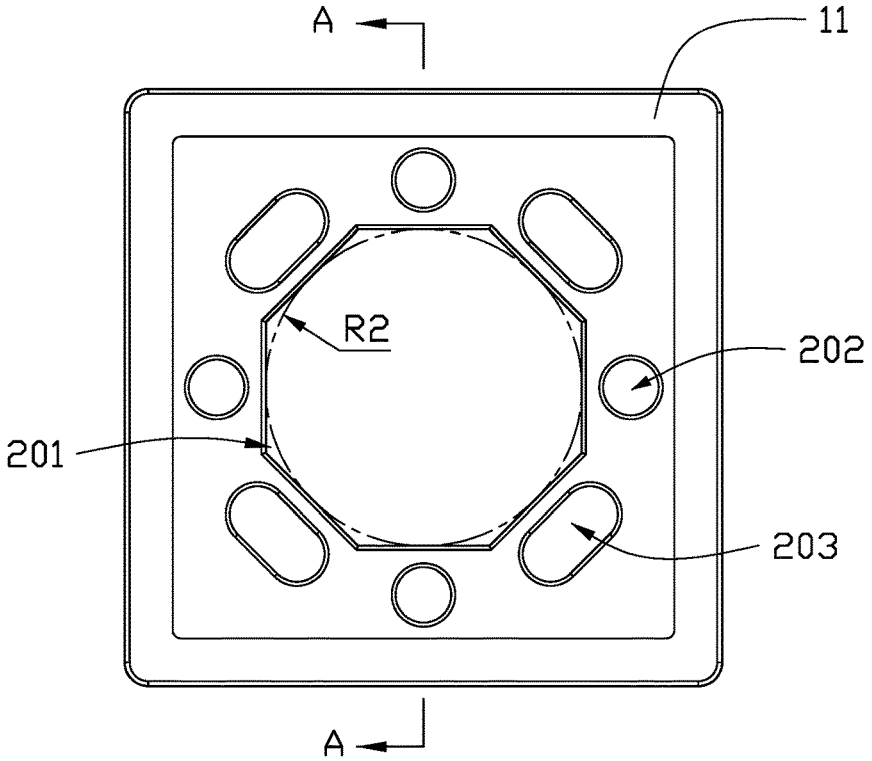
FIG. 15 is a front schematic diagram of a magnetic block of the present disclosure.
Figure 16:
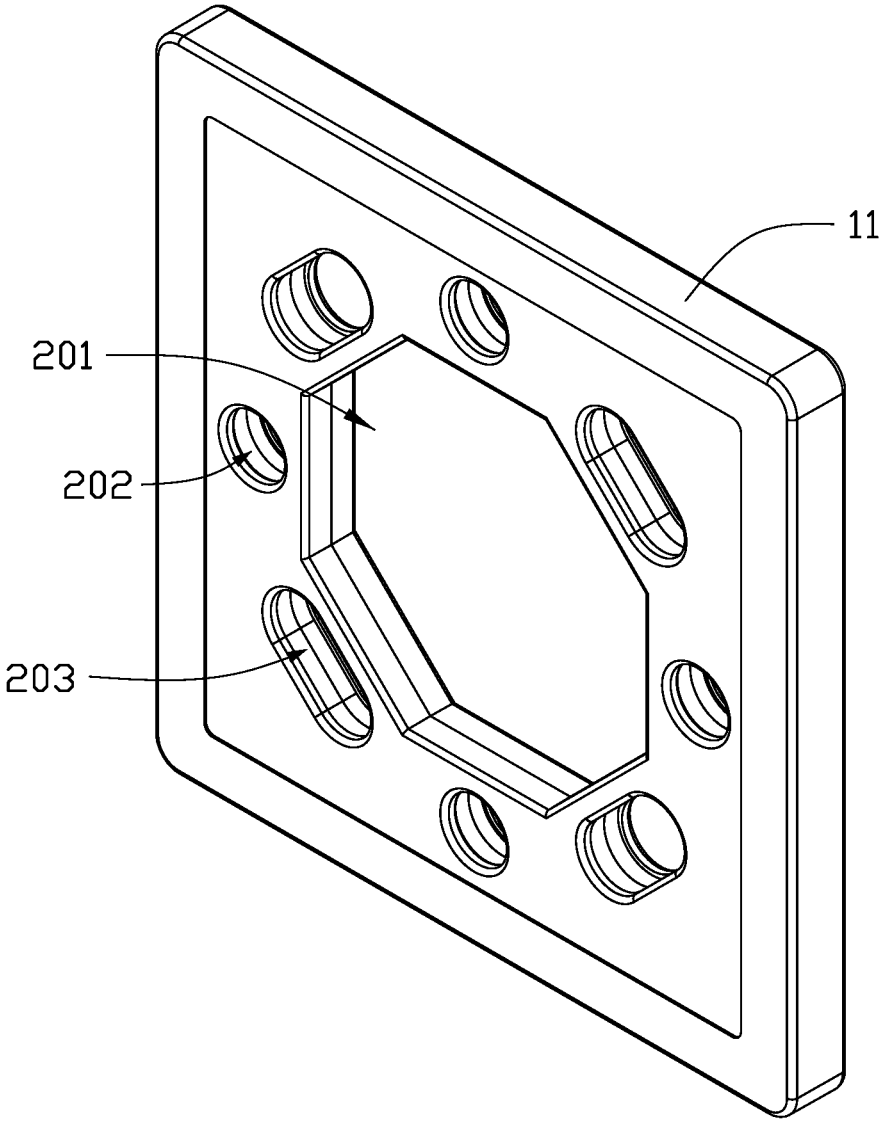
FIG. 16 is a three-dimensional structural schematic diagram of the magnetic block of the present disclosure.

Referring to FIGS. 15-16 and 12, a polygonal hole 201 is defined on each of the magnetic blocks 11, and four round holes 202 and four long oval holes 203 are evenly defined around the polygonal hole 201. An internal diameter R2 of the polygonal hole 201 is larger than the outer diameters R1 of the path opening extensions 104 of the connecting platforms 100, and the polygonal hole 201 is capable of accommodating each of the path opening extensions 104 of the connecting platforms 100.

Figure 17:
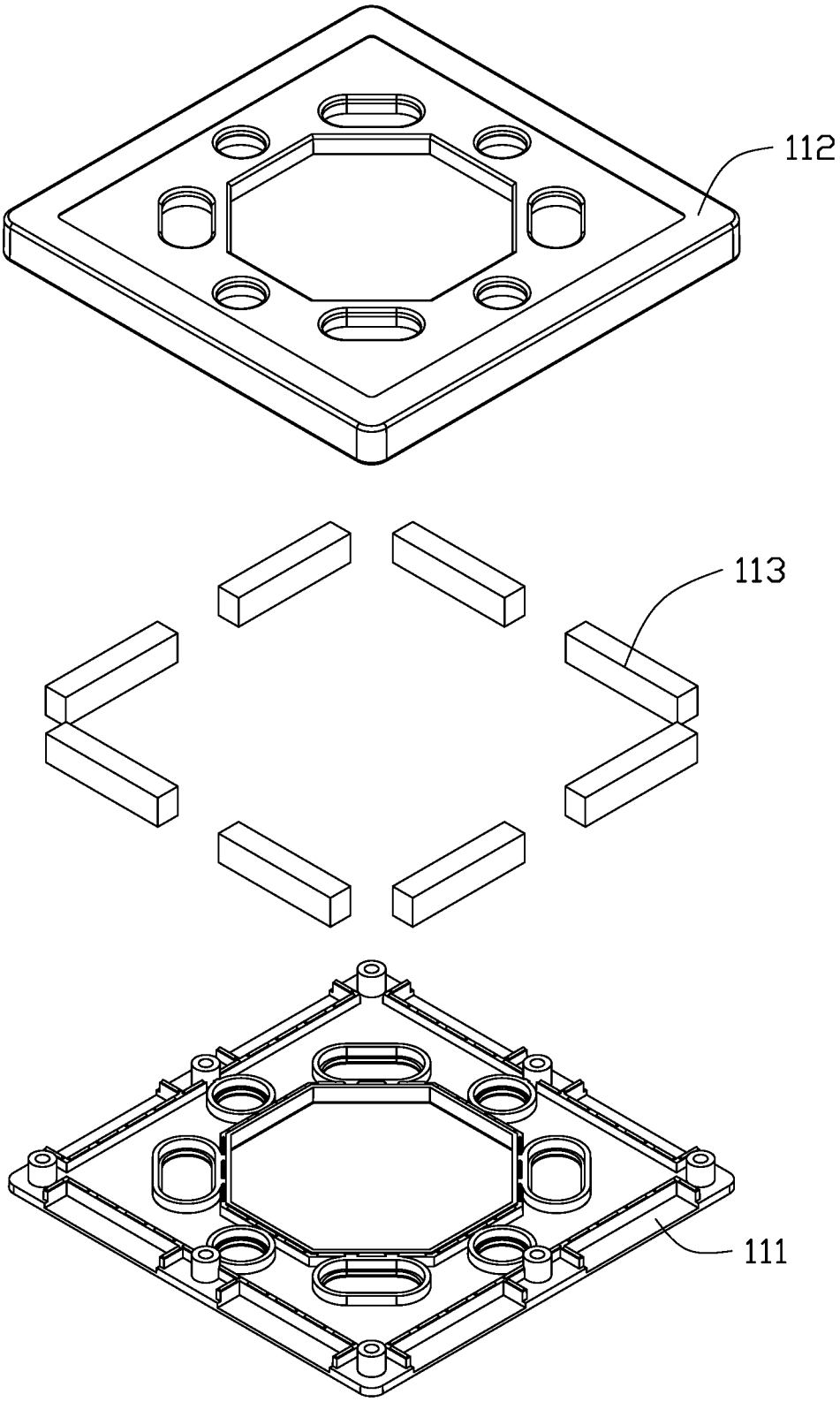
FIG. 17 is an exploded schematic diagram of the magnetic block of the present disclosure.

Referring to FIG. 17, eight magnets 113 are disposed on four side surfaces of each of the magnetic blocks 11, each of the magnetic blocks 11 is assembled with a magnetic block cover 111 on a top and a magnetic block bottom 112 at a bottom, the magnetic block bottom 112 is assembled through ultrasonic welding. The magnetic blocks 11 which are welded are connected together by two-by-two adsorption through the magnets 113 on sides.

Figure 18:
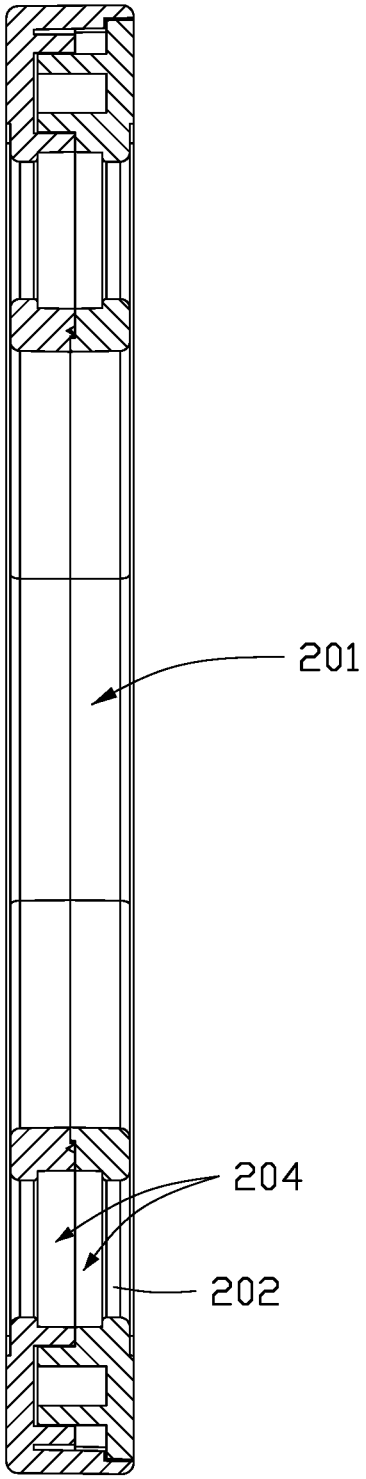
FIG. 18 is a cross-sectional schematic diagram of an inner portion of the magnetic block of the present disclosure taken along the line A-A shown in FIG. 15.

Referring to FIGS. 16 and 18, a respective one of concave platforms 204 are disposed on an inner side of a respective one of the four round holes 202 of each of the magnetic blocks 11. Combined with FIGS. 19-20, the inserting column 101 of each of the track sections is capable of inserting into the respective one of the four round holes 202 of each of the magnetic blocks 11. A respective one of the inverted buckles 105, on the inserting column 101, is buckled on the respective one of the concave platforms 204, disposed on the inner side of the respective one of the round holes 202 of each of the magnetic blocks 11 for tightly assembling the toy track set.

Figure 19:
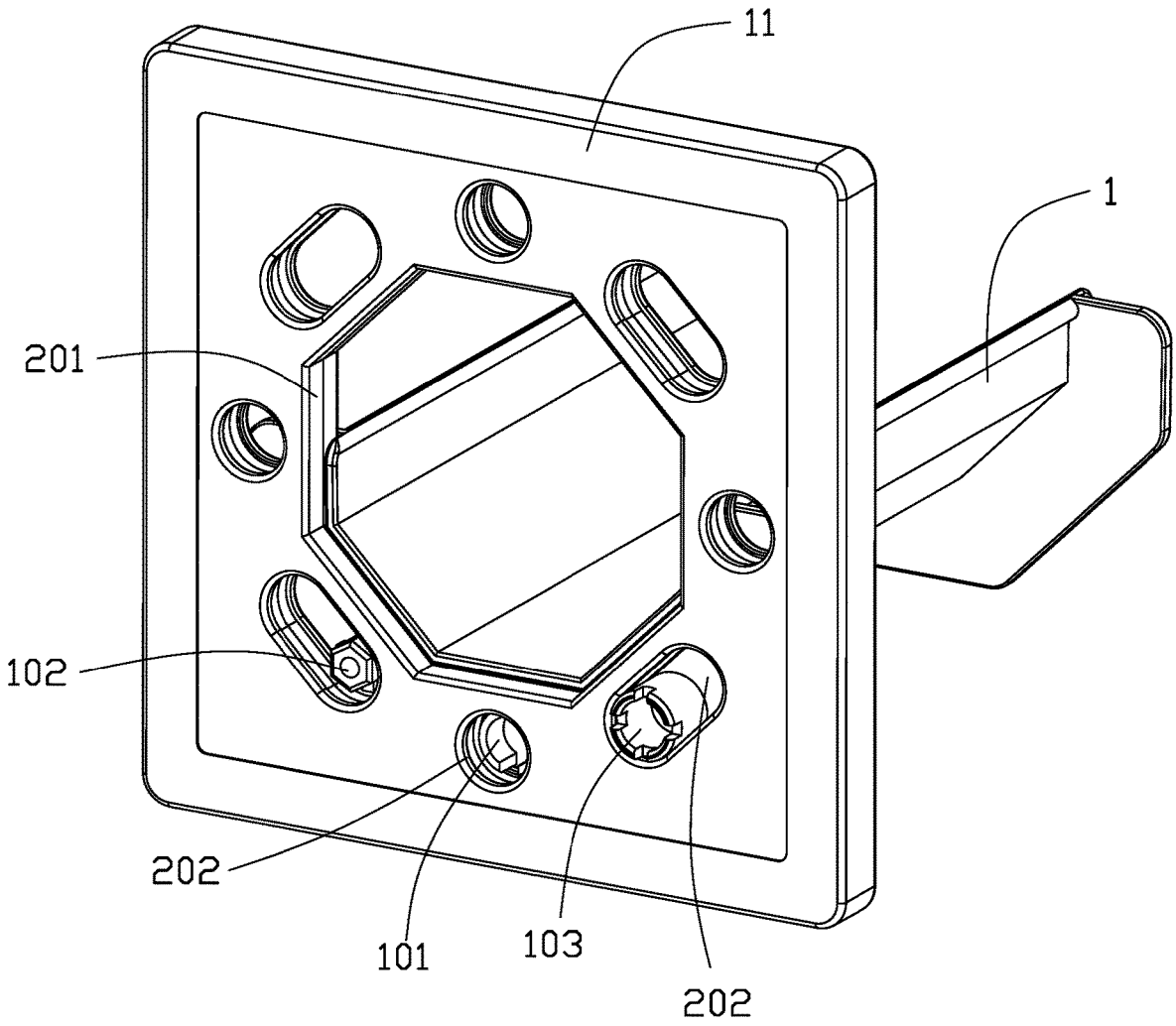
FIG. 19 is a schematic diagram of a connection between the magnetic block and each of the track sections of the present disclosure.
Figure 20:
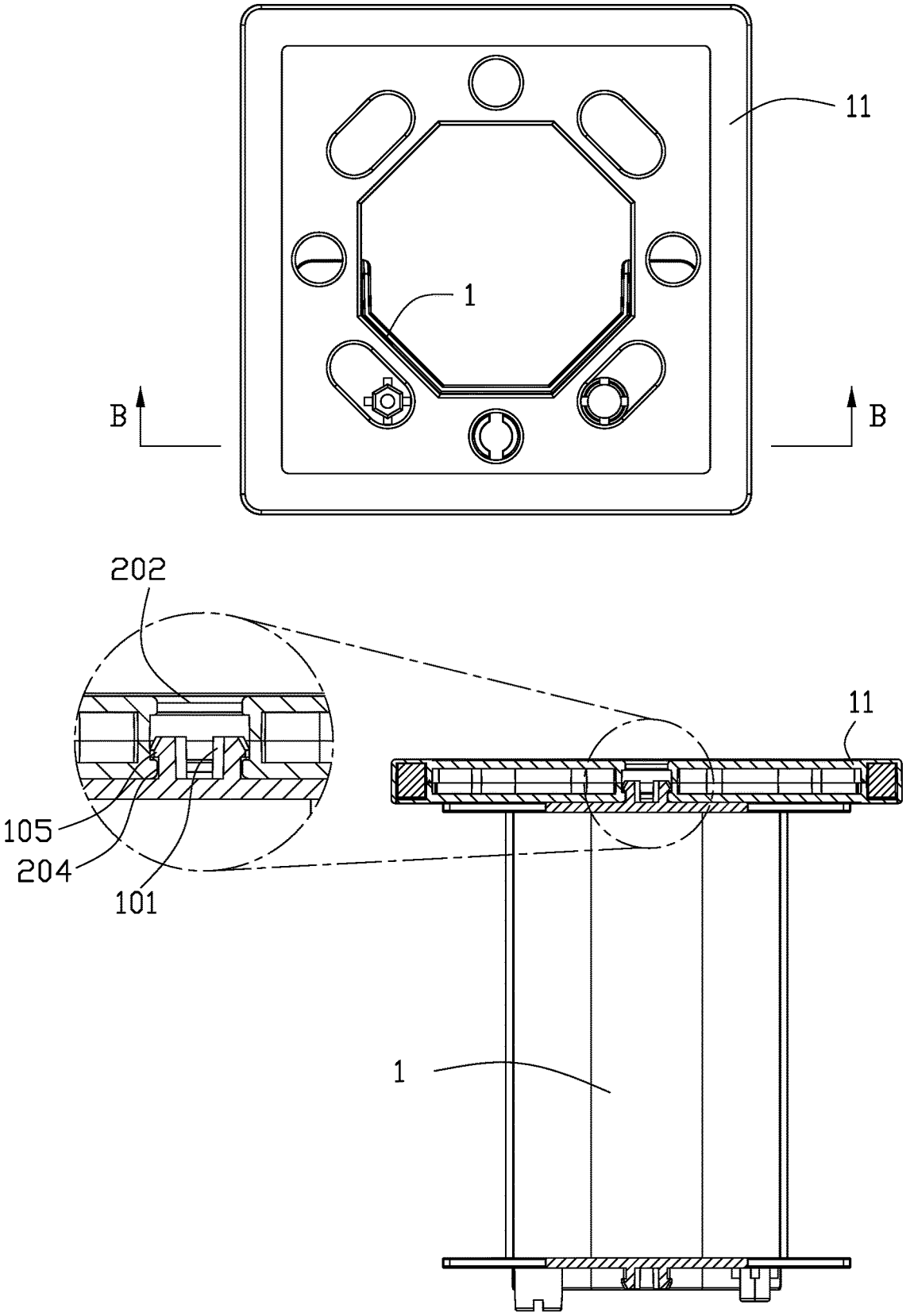
FIG. 20 is a cross-sectional schematic diagram of an inner portion of the connection of the magnetic block and each of the track sections of the present disclosure.
Figure 21:
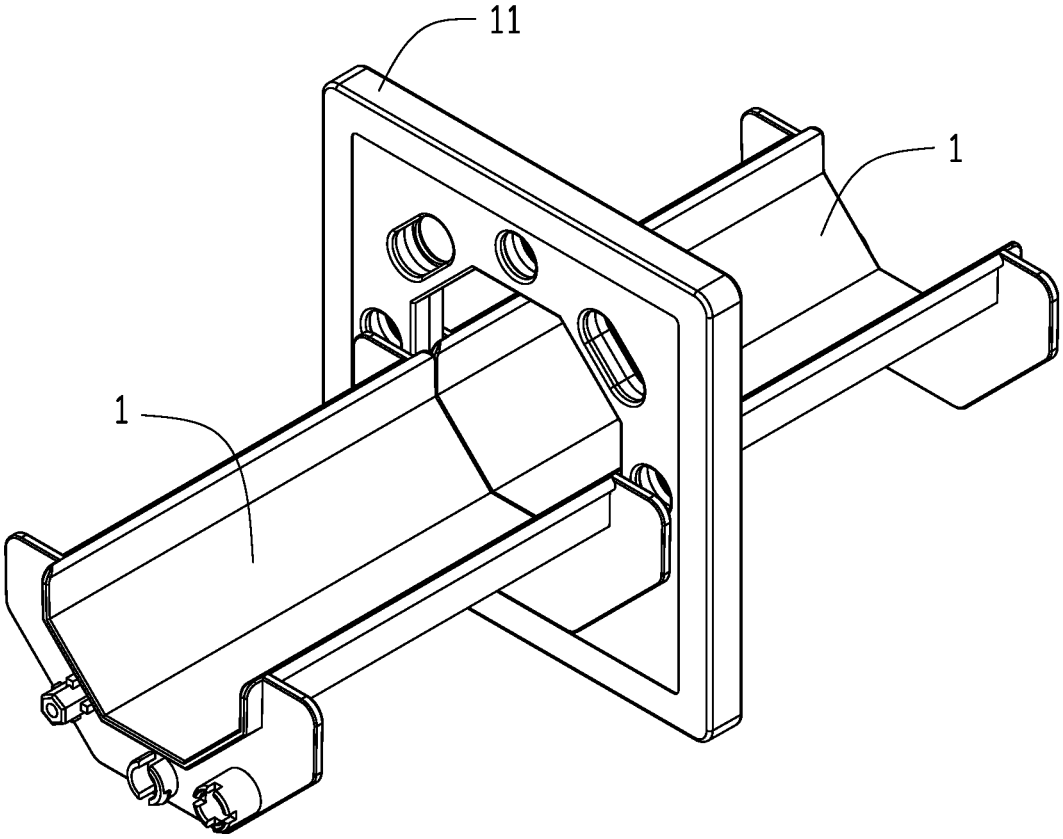
FIG. 21 is a schematic diagram of a connection between the magnetic block and two of the track sections of the present disclosure.

Referring to FIGS. 19-21, two surfaces of each of the magnetic blocks 11 are capable of simultaneously connecting with the plurality of the track sections. That is, a thickness of the polygonal hole is not less than two times a length of the path opening extensions. After one of the plurality of the track sections is connected to a first side of a respective one of the magnetic blocks 11, a respective one of the connecting columns 102 and a respective one of the connecting holes 103 on two sides of a respective one of the connecting platforms 100 of the one of the plurality of the track sections penetrate through a respective one of long oval holes 202 on the respective one of the magnetic blocks 11 to connect to another one of the plurality of the track sections at a second side of the respective one of the magnetic locks 11.

Figure 22:
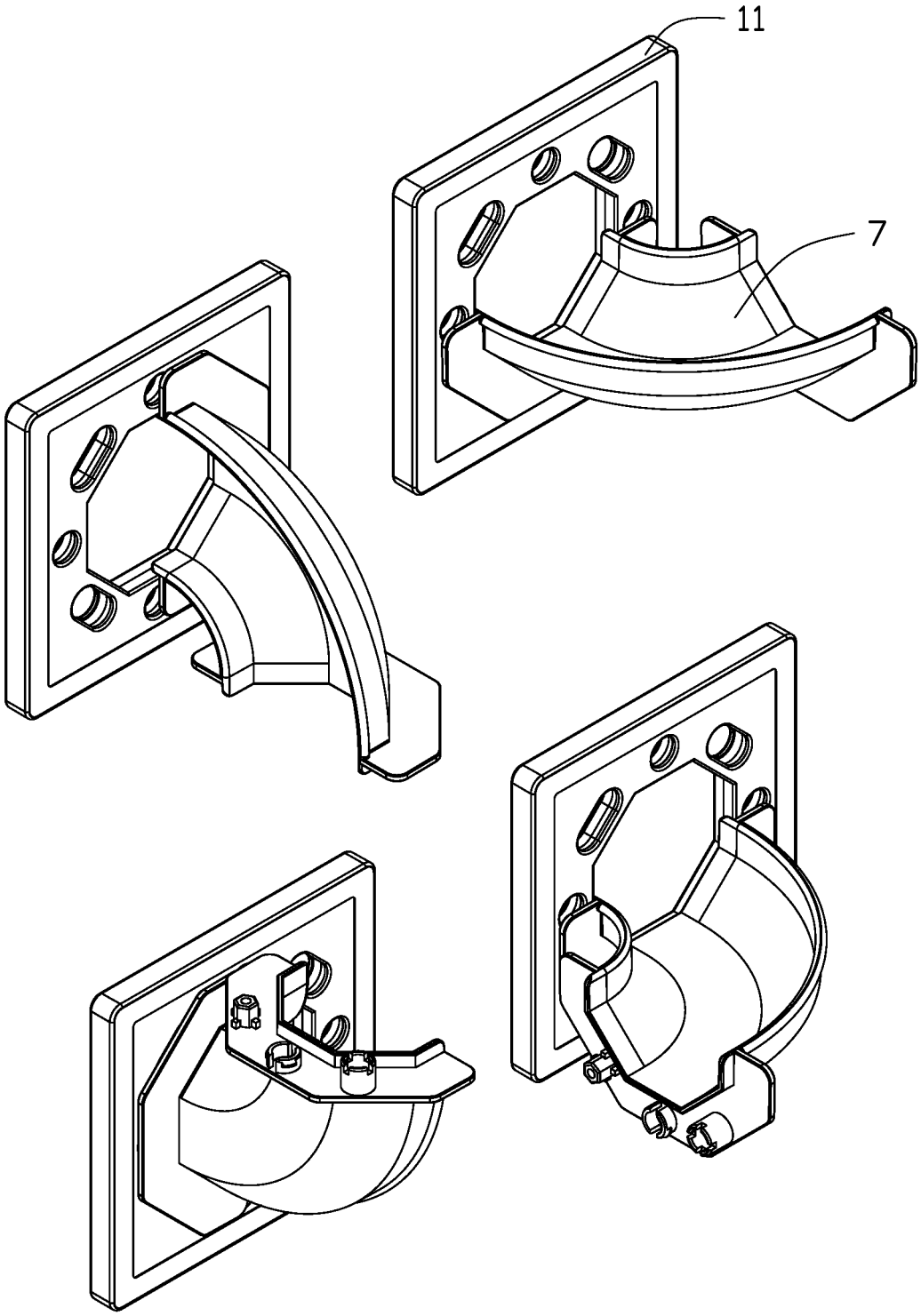
FIG. 22 is a schematic diagram of four connecting directions of the connection between the magnetic block and the two of the track sections of the present disclosure.

Referring to FIG. 22, one connection embodiment of one of the magnetic blocks 11 and the track sections is shown. An inserting column 101 on each of the plurality of the track sections is capable of inserting into any one of four round holes 202 on each of the magnetic blocks 11 for changing an assembling direction of the plurality of the track sections to achieve changes in four directions.

Figure 23:
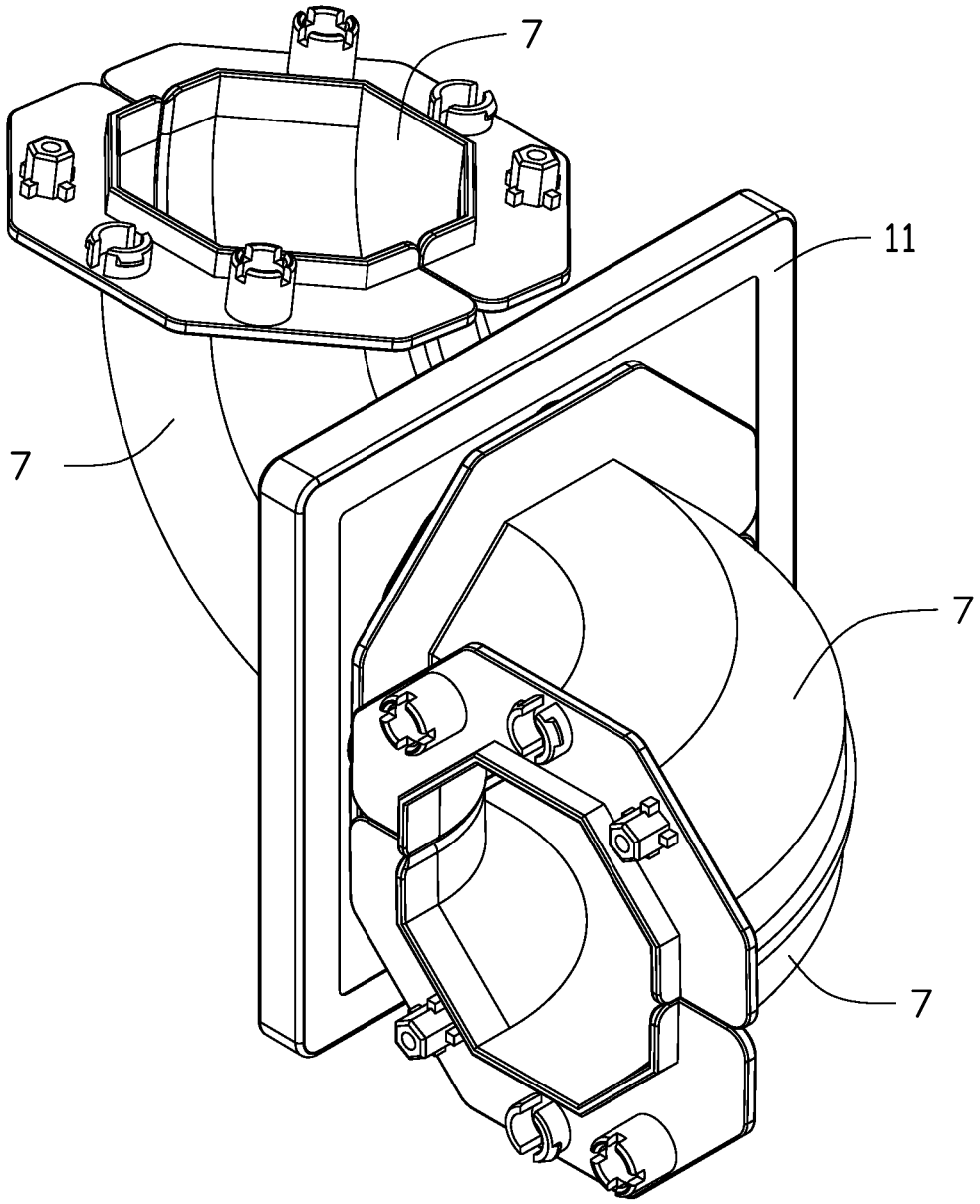
FIG. 23 is a schematic diagram of a connection between the magnetic block and four of the track sections of the present disclosure.

Referring to FIG. 23, one connection embodiment of one of the magnetic blocks 11 and the track sections is shown. Identical two of the plurality of the track sections are simultaneously connected to a respectively one of the magnetic blocks 11 from up and down to form a closed path.

Figure 24:
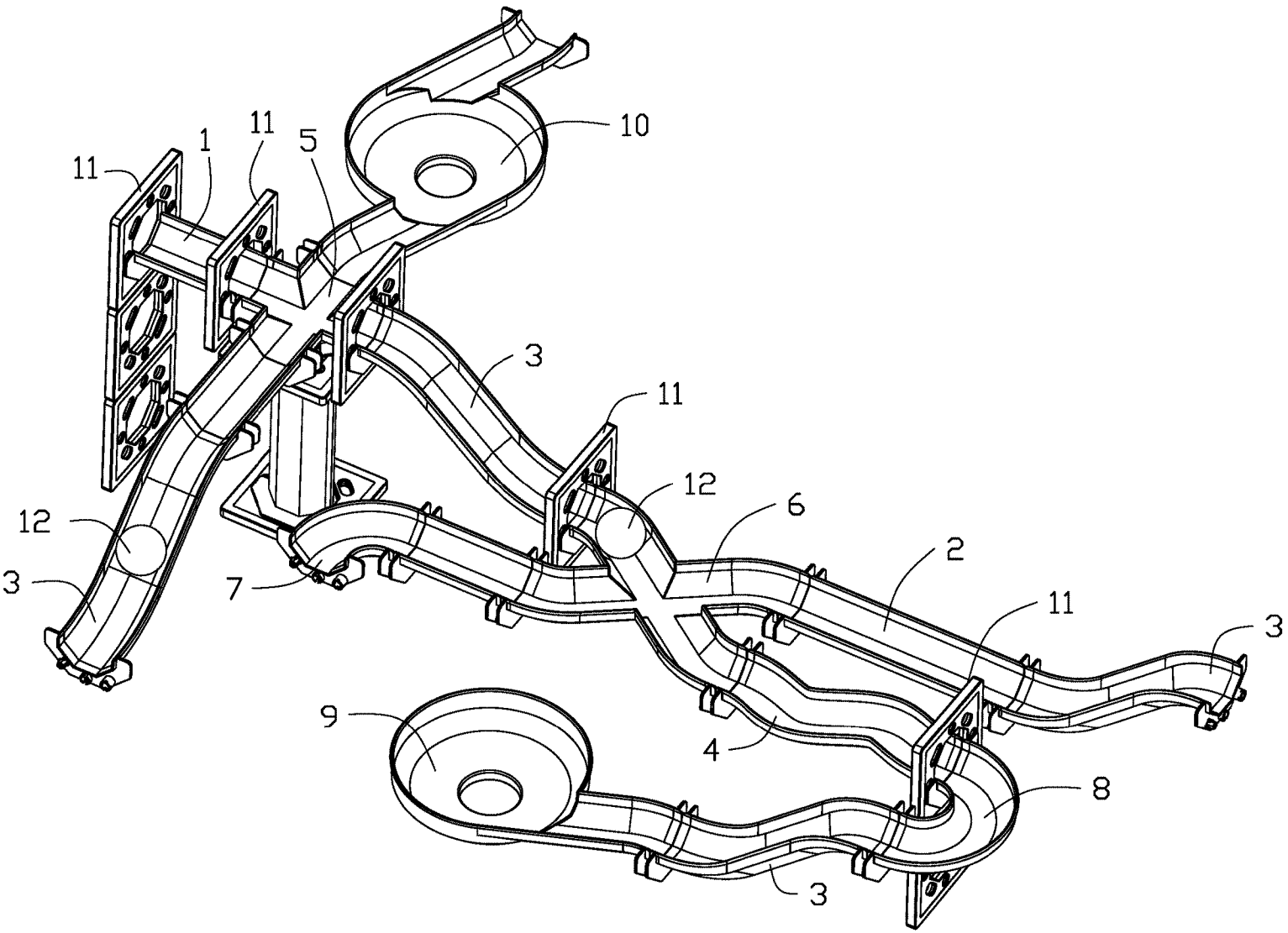
FIG. 24 is a schematic diagram of a toy track set, where the toy track set is completely assembled, of the present disclosure.

Referring to FIG. 24, FIG. 24 shows one embodiment of the toy track set, where the toy track set is completely assembled. The track sections and the magnetic blocks 11 are assembled to form different paths, and the toy ball 12 is capable of rolling in the different paths

What is claimed is:

1. A toy track set, comprising:

a plurality of track sections;

magnetic blocks;

a toy ball;

wherein the plurality of the track sections is in different shapes; the plurality of the track sections comprises a first track section, a second track section, a third track section, a fourth track section, a fifth track section, a sixth track section, a seventh track section, an eighth track section, a ninth track section, and a tenth track section; the first track section and the second track section are straight-shaped, the third track section is in a slope-shaped, the fourth track section is S-shaped, the fifth track section and the sixth track section are cross-shaped, the seventh track section is 90-degree bent, the eighth track section is 180-degree bent, and the ninth track section and the tenth track section are disk-shaped; the plurality of the track sections is connected through connecting columns and connecting holes of connecting platforms to form paths having different styles; the plurality of the track sections is assembled with the magnetic blocks through buckling inverted buckles with concave platforms for enhancing construction of the paths; and the toy ball rolls in the paths; and wherein a polygonal hole is defined on each of the magnetic blocks, and four round holes and four long oval holes are evenly defined around the polygonal hole; an internal diameter of the polygonal hole is larger than the outer diameters of the path opening extensions of the connecting platforms; and the polygonal hole is capable of accommodating each of the path opening extensions of the connecting platforms.

2. The toy track set according to claim 1, wherein the connecting platforms are respectively disposed on each of connecting ends of each of the first track section, the second track section, the third track section, the fourth track section, the fifth track section, the sixth track section, the seventh track section, the eighth track section, the ninth track section, and the tenth track section; an inserting column is disposed on a middle of each of the connecting platforms; a respective one of the inverted buckles is disposed on an outer side surface of the inserting column; a respective one of the connecting columns and a respective one of the connecting holes are respectively disposed on two sides of each of the connecting platforms; any two of the plurality of the track sections are mutually connected through the connecting columns and the connecting holes; and outer diameters of path opening extensions of the connecting platforms are the same.

3. The toy track set according to claim 1, wherein magnets are disposed on four side surfaces of each of the magnetic blocks, and the magnetic blocks are connected together through magnetic force.

4. The toy track set according to claim 1, wherein a respective one of the concave platforms are disposed on an inner side of a respective one of round holes of each of the magnetic blocks, an inserting column of each of the connecting platforms is capable of inserting into the respective one of the round holes of each of the magnetic blocks; a respective one of the inverted buckles, on the inserting column, is buckled on the respective one of the concave platforms, disposed on the inner side of the respective one of the round holes of each of the magnetic blocks for tightly assembling the toy track set.

5. The toy track set according to claim 1, wherein two surfaces of each of the magnetic blocks are capable of simultaneously connecting with the plurality of the track sections; after one of the plurality of the track sections is connected to a first side of a respective one of the magnetic blocks, a respective one of the connecting columns and a respective one of the connecting holes on two sides of a respective one of the connecting platforms of the one of the plurality of the track sections penetrate through a respective one of long oval holes on the respective one of the magnetic blocks to connect to another one of the plurality of the track sections at a second side of the respective one of the magnetic locks.

6. The toy track set according to claim 1, wherein an inserting column on each of the plurality of the track sections is capable of inserting into any one of four round holes on each of the magnetic blocks for changing an assembling direction of the plurality of the track sections to achieve changes in four directions.

7. The toy track set according to claim 1, wherein identical two of the plurality of the track sections are simultaneously connected to a respective one of the magnetic blocks from up and down to form a closed path.

8. A toy track set, comprising:

a plurality of track sections;

magnetic blocks; and a toy ball;

wherein the plurality of the track sections is in different shapes; the plurality of the track sections comprises a first track section, a second track section, a third track section, a fourth track section, a fifth track section, a sixth track section, a seventh track section, an eighth track section, a ninth track section, and a tenth track section; the first track section and the second track section are straight-shaped, the third track section is in a slope-shaped, the fourth track section is S-shaped, the fifth track section and the sixth track section are cross-shaped, the seventh track section is 90-degree bent, the eighth track section is 180-degree bent, and the ninth track section and the tenth track section are disk-shaped; the plurality of the track sections is connected through connecting columns and connecting holes of connecting platforms to form paths having different styles; the plurality of the track sections is assembled with the magnetic blocks through buckling inverted buckles with concave platforms for enhancing construction of the paths; and the toy ball rolls in the paths;

wherein the connecting platforms are respectively disposed on each of connecting ends of each of the first track section, the second track section, the third track section, the fourth track section, the fifth track section, the sixth track section, the seventh track section, the eighth track section, the ninth track section, and the tenth track section; an inserting column is disposed on a middle of each of the connecting platforms; a respective one of the inverted buckles is disposed on an outer side surface of the inserting column; a respective one of the connecting columns and a respective one of the connecting holes are respectively disposed on two sides of each of the connecting platforms; any two of the plurality of the track sections are mutually connected through the connecting columns and the connecting holes; and outer diameters of path opening extensions of the connecting platforms are the same.

9. A toy track set, comprising:

a plurality of track sections;

magnetic blocks; and a toy ball;

wherein the plurality of the track sections is in different shapes; the plurality of the track sections comprises a first track section, a second track section, a third track section, a fourth track section, a fifth track section, a sixth track section, a seventh track section, an eighth track section, a ninth track section, and a tenth track section; the first track section and the second track section are straight-shaped, the third track section is in a slope-shaped, the fourth track section is S-shaped, the fifth track section and the sixth track section are cross-shaped, the seventh track section is 90-degree bent, the eighth track section is 180-degree bent, and the ninth track section and the tenth track section are disk-shaped; the plurality of the track sections is connected through connecting columns and connecting holes of connecting platforms to form paths having different styles; the plurality of the track sections is assembled with the magnetic blocks through buckling inverted buckles with concave platforms for enhancing construction of the paths; and the toy ball rolls in the paths;

wherein two surfaces of each of the magnetic blocks are capable of simultaneously connecting with the plurality of the track sections; after one of the plurality of the track sections is connected to a first side of a respective one of the magnetic blocks, a respective one of the connecting columns and a respective one of the connecting holes on two sides of a respective one of the connecting platforms of the one of the plurality of the track sections penetrate through a respective one of long oval holes on the respective one of the magnetic blocks to connect to another one of the plurality of the track sections at a second side of the respective one of the magnetic locks.

* * * * *